United States Patent [19]

Christ et al.

[11] Patent Number: 4,716,075

[45] Date of Patent: Dec. 29, 1987

[54] PROTECTED METAL ARTICLE AND METHOD OF MAKING

[75] Inventors: Christy Christ, Trenton; Herbert F. Campbell, Franklin, both of Ohio; Gayle P. Fields, Ashland; James L. Burris, Russell, both of Ky.

[73] Assignee: Armco Inc., Middletown, Ohio

[21] Appl. No.: 849,986

[22] Filed: Apr. 10, 1986

[51] Int. Cl.[4] ..... D21F 11/00; D21H 5/12; B32B 15/00; B32B 17/00

[52] U.S. Cl. ..... 428/285; 428/287; 428/418; 428/458; 162/146; 162/157.3; 162/157.4; 162/157.5; 162/149; 162/206; 174/110 R

[58] Field of Search ..... 428/285, 287, 458, 418; 162/146

[56] References Cited

U.S. PATENT DOCUMENTS

| | | | |
|---|---|---|---|
| Re. 29,726 | 8/1978 | Byrd et al. | 427/320 |
| 2,073,334 | 3/1937 | Coffman | 154/2 |
| 2,136,942 | 11/1938 | Freeze | 113/35 |
| 2,631,641 | 3/1953 | Coffman | 154/1 |
| 2,668,348 | 2/1954 | Hubbell | 29/195 |
| 2,724,177 | 11/1955 | Coffman et al. | 29/472.9 |
| 2,824,020 | 2/1958 | Cook et al. | 117/51 |
| 2,994,788 | 9/1961 | Morgan | 162/146 |
| 3,077,032 | 2/1963 | Oganowski | 29/473.1 |
| 3,101,294 | 8/1963 | Fridricksen | 162/146 |
| 4,152,471 | 5/1979 | Schnedler et al. | 427/321 X |
| 4,250,223 | 2/1981 | Cook | 428/458 X |
| 4,287,248 | 9/1981 | Gessner et al. | 428/458 X |

FOREIGN PATENT DOCUMENTS 594136 3/1960 Canada .

*Primary Examiner*—George F. Lesmes
*Assistant Examiner*—D. R. Zirker
*Attorney, Agent, or Firm*—R. J. Bunyard; L. A. Fillnow; R. H. Johnson

[57] ABSTRACT

A culvert having a corrosion resistant composite coating and a method of producing the corrosion resistant composite coating. The coating method is for use in a conventional hot dip coating line of the type wherein a steel strip, having been appropriately pretreated so as to be at or above the coating temperature and have its surface free of oxides, is caused to pass through a bath of molten coating metal. A fibrous aramid paper is bonded to the surface of the steel strip by pressing the fibers into the molten coating layer immediately after the steel strip exits the coating bath. The steel strip may be fabricted into construction products such as culvert which may be further protected with bituminous type coatings.

5 Claims, 14 Drawing Figures

PROTECTED METAL ARTICLE AND METHOD OF MAKING

BACKGROUND OF THE INVENTION

This invention relates to protected metal articles and a method of producing a corrosion resistant composite coating. More particularly, the invention relates to a metallic coated ferrous strip of the type produced on a conventional hot dip coating line having polymeric fibers embedded in the metallic coating.

It is well known to provide corrosion protection to metal articles, such as steel sheets with a hot dip metallic coating. It is also well known the corrosion protection can be enhanced by dipping the metallic coated articles into a bituminous material. However, a bituminous coating does not readily bond to hot dip metallic coatings such as zinc, aluminum or lead. In the past, a thin asbestos felt or paper like layer of short asbestos fibers was embedded into a molten hot dip metallic coating. Random asbestos fibers became embedded in the solidified metallic coating and projected therefrom to provide an anchor for a bituminous coating. Hence, the primary purpose for bonding asbestos felt or paper to a hot dip metallic coated steel sheet is to form a composite metal-bituminous coating.

Such asbestos felt or paper for bonding a bituminous coating has been advantageously used over the years because it was inexpensive. However, there are several disadvantages. A first disadvantage is that the felt or paper is of very low tensile strength and easily tears when used in a continuous process. Accordingly, asbestos felt or paper is normally used as cut sheets in a more expensive batch type process. Steel sheets may be fed into a flux covered coating pot containing a bath of molten metal, such as aluminum or zinc. After a metallic coated sheet exits from the coating pot, a thin sheet of asbestos felt or paper is pressed into the molten coating metal using bonding rollers. The metallic coating is alloyed to the steel sheet and anchors the asbestos fibers. Hot dip metallic coating of short lengths of steel sheets using the flux process is very slow and produced at line speeds under 15 ft./min. (4.5 m/min.). Coating metal is wasted when excess molten metal is carried from the coating pot.

A second disadvantage is deterioration due to abrasion of the bonded asbestos felt or paper layer. When the asbestos layer is pressed into a molten metallic coating, the organic binders holding the fibers together are burned. Consequently, the embedded fiber layer has poor mechanical properties. Fabrication of coated steel sheets into articles tends to cause the fiber layer to craze or flake. Also, asbestos has very low tensile strength and individual fibers tend to break. Because of these physical characteristics, a coated steel sheet to be fabricated must have its asbestos layer impregnated with a saturant such as asphalt. The saturant provides protection to the fragile asbestos fibers during handling, shipping and fabrication of metallic coated steel sheets.

A third disadvantage of using asbestos is the environmental considerations. The potential health hazards related to breathing air laden with asbestos particles are well known. The asbestos fibers in the paper are bonded together using organic materials such as animal hair, wood pulp and resin. The galvanizing pot described above will be operated above a temperature of 830° F. (443° C.). The organic materials present in the asbestos felt readily burn giving off large amounts of smoke and noxious fumes. The saturating step described above also gives off smoke and noxious fumes as well.

A fourth disadvantage is the limited formability of hot dip metallic coated steel sheets having an asbestos felt or paper embedded in the metallic coating. It is well known to fabricate such steel sheets into building panels and riveted pipe. Pipe made by riveting is labor intensive since individual sections must be assembled by hand.

Unlike riveted pipe which is made from short lengths, helical formed pipe normally is made from a continuous length of strip. It has been suggested in the prior art that continuous asbestos felt or paper may be bonded to hot dip metallic coated strip. U.S. Pat. No. 3,077,032 suggests continuous asbestos felt may be bonded to ferrous strip emerging from a coating pot containing molten coating metal as the strip passes in a vertical direction. However, no one has commercially produced a hot dip metallic coated ferrous strip having an outer continuous asbestos felt or paper layer which was fabricated into articles such as helically formed pipe. Strip is metallic coated at line speeds much greater than that for sheets. Accordingly, a certain amount of back tension would have to be maintained on the paper roll as asbestos paper was fed into a bonding roller. Because of low tensile strength, the asbestos paper would frequently tear. More importantly, the organic binders in the asbestos paper immediately burn upon contact with the hot bonding roller and metallic coating. The paper tends to separate upon contact with either of these hot surfaces if the tension is too great or there is any interruption in the line speed of the as-coated strip. Even if such a continuous process were possible, the environmental problems in a workplace associated with asbestos paper are no longer acceptable.

The prior art as also suggested substituting other papers containing inorganic heat resistant fibers such as glass or carbon for asbestos. Unlike asbestos fibers, silica or carbon fibers do not bond well with metallic coatings, i.e. zinc. Even if they would bond, carbon or glass fibers are too brittle to be fabricated. Accordingly, paper made from fibrous carbon or glass is not an acceptable substitute for asbestos.

There has been a need for many years to find a heat resistant and strong fibrous felt or paper capable of being bonded with a hot dip metallic coated ferrous strip. There has also been a need for a paper which is environmentally acceptable in the workplace. We have discovered that a nonwoven organic fibrous paper made from heat resistant synthetic polymer fibers provides an improved bond with metallic coatings and its strength and toughness are maintained or even increased after contact with the molten coating metal. The improved toughness of the paper after bonding with the metallic coating allows the ferrous strip to be fabricated into building and construction products such as helically formed drainage culvert.

BRIEF SUMMARY OF THE INVENTION

This invention relates to a method of forming a hot dip metallic coating having polymeric fibers embedded therein to at least one side of continuous ferrous base strip and articles made therefrom. The metallic coating is formed using a conventional hot dip metallic coating line. After a ferrous strip emerges from a coating pot, a heat resistant nonwoven thin paper made from synthetic polymeric fibers is pressed into a molten coating layer on the strip. The fibrous paper is a fusion bonded composite of staple fiber and fibrid binding agent having a degradation temperature above the melting point of the coating metal.

After the fibrous paper becomes bonded with the solidified metallic coating, the ferrous strip is preferably fabricated into a metal article such as a drainage culvert. The strip is passed through corrugating rollers which preferably include means for producing cooperating seam elements along the strip edges. The strip may then be fabricated into helically formed pipe using a pipe forming means. The culvert may receive additional corrosion protection by being covered with a bituminous coating on at least one side thereof.

It is a principal object of this invention to form a hot dip metallic coating layer including an embedded non-woven paper of synthetic polymeric fibers onto a continuous ferrous strip.

Another object is to fabricate the strip into an article such as a helically formed culvert having an adherent composite coating.

Advantages of this invention are reduction in costs of producing a hot dip metallic coated ferrous strip having an embedded polymeric fibrous layer and articles made therefrom and elimination of asbestos and smoke from the work environment.

The above and other objects, features and advantages of this invention will become apparent upon consideration of the detailed description and appended drawing.

DETAILED DESCRIPTION OF THE PREFERRED EMBODIMENT

Figure 1:
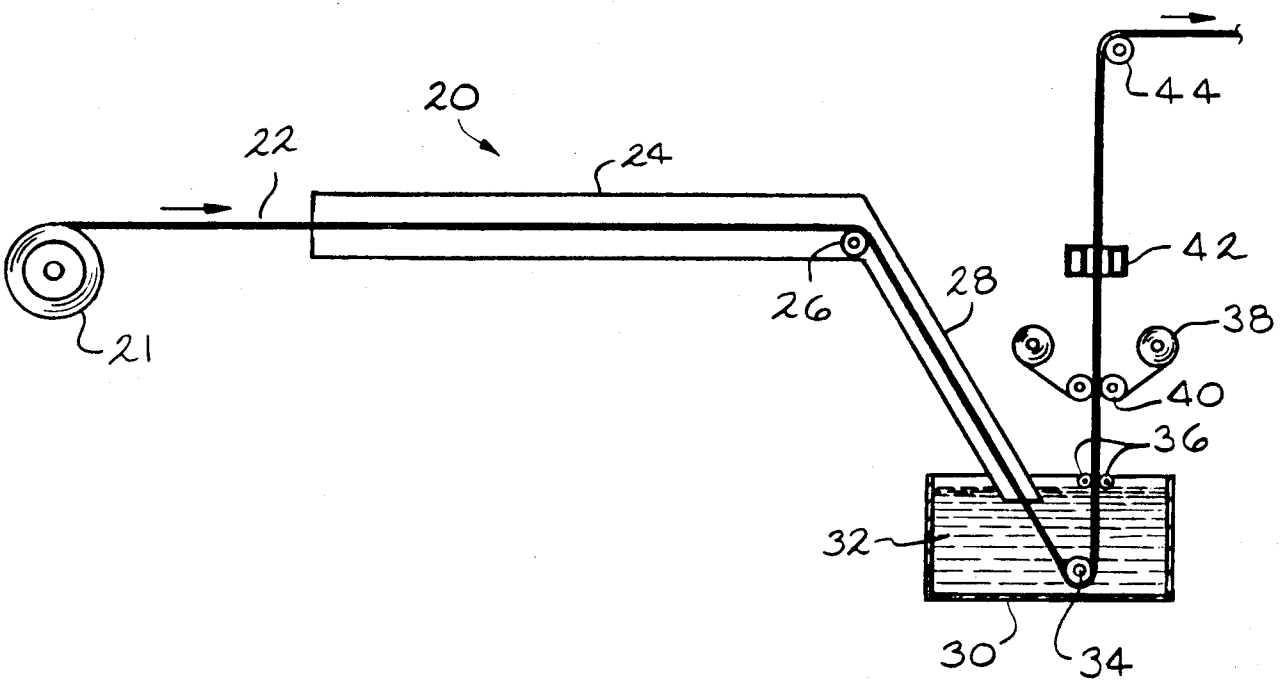
FIG. 1 is a schematic view of a continuous ferrous strip being processed through a conventional hot dip metallic coating line incorporating the present invention.

Referring now to FIG. 1, the reference numeral 20 denotes a high speed continuous galvanizing line incorporating the present invention. The specific operation shown is for two-side hot dip metallic coating. It will be understood the present invention may also be performed using a one-side hot dip coating line or continuous coating lines using other coating metals such as aluminum, lead, tin and alloys thereof.

Reference numeral 22 denotes a ferrous strip being fed from coil 21 into treating furnace 24. Strip 22 is directed by roller 26 into hood 28 and then into coating pot 30 containing a molten coating metal 32. Sink roller 34 redirects the ferrous strip vertically through coating rollers 36. Alternative coating wiping means such as gas finishing as is well known may be used for controlling the weight of metallic coating.

For continuous hot dip coating lines, the ferrous strip normally is heated to at least above the melting point of the coating metal 32 to prevent casting of the coating metal. For galvanized coating, we prefer to heat strip 22 to a temperature above 1000° F. (538° C.) to remove oxides, dirt and other contaminants to enhance adherence of the applied metallic coating. For the present invention, it is important to cool the strip to near the melting point of the coating metal before strip 22 enters coating pot 30. The melting point for essentially pure zinc is about 790° F. (420° C.). If enhanced corrosion protection is desired, varying amounts of aluminum may be added to the coating alloy or an aluminum based coating may be used. Depending on the coating metal composition, the melting point could be as high as 1225° F. (665° C.).

Details of the above type strip pretreatment process can be found in U.S. Pat. No. Re. 29,726 which is incorporated herein by reference. Those skilled in the art will appreciate our invention may also be used with hot dip flux processes wherein the strip is chemically cleaned such as is disclosed in U.S. Pat. No. 2,824,020 which is also incorporated herein by reference.

After the coated strip passes through coating rollers 36, non-woven synthetic polymer fibrous sheet 60 from roll 38 is pressed into the coating metal by bonding rollers 40. Hereinafter, sheet 60 will be referred to as composite paper or paper. Gaseous cooling means 42 may be needed to solidify the metallic coating prior to the strip engaging change of direction roller 44. Although only one pair of bonding rollers 40 is shown in the FIGS., in those situations where additional cooling capacity may be needed, a second pair of bonding rollers may be mounted a short distance above rollers 40.

Figure 2:
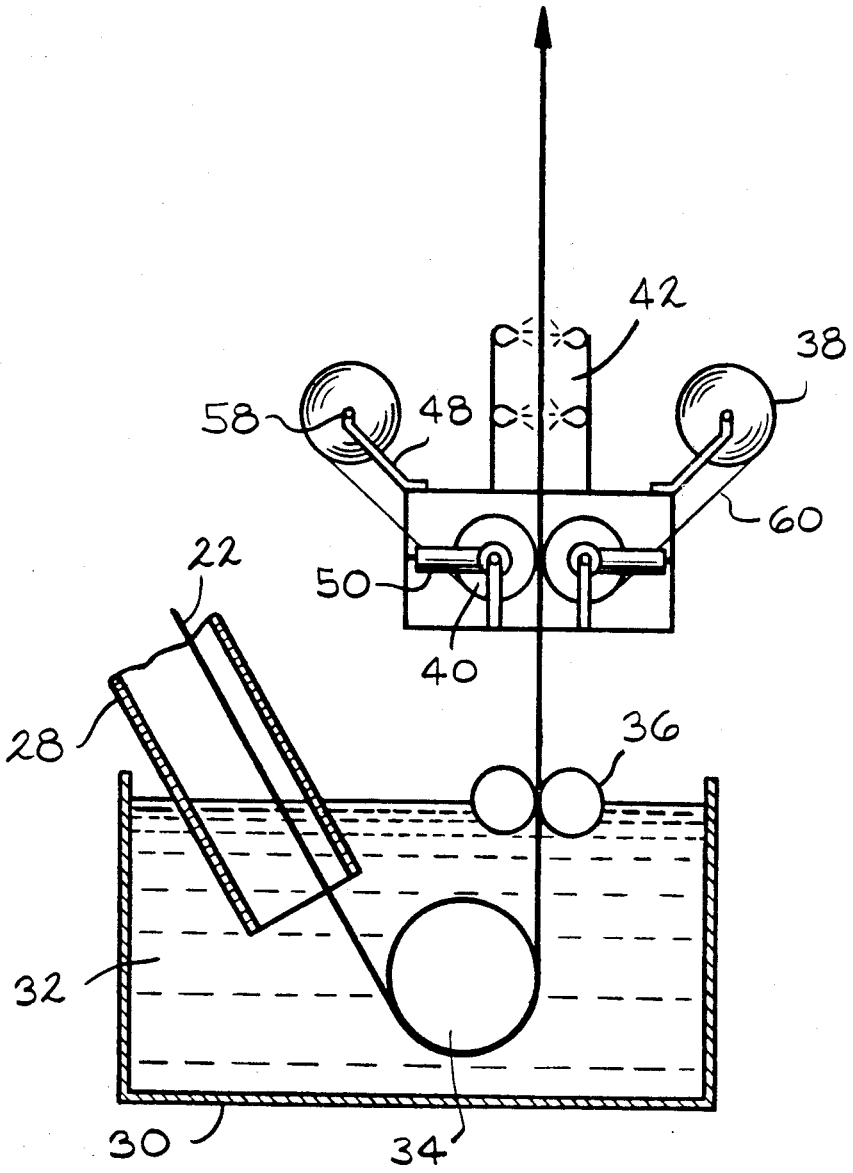
FIG. 2 is a partial schematic view of the coating line of FIG. 1 showing hot dipping and paper bonding.
Figure 3:
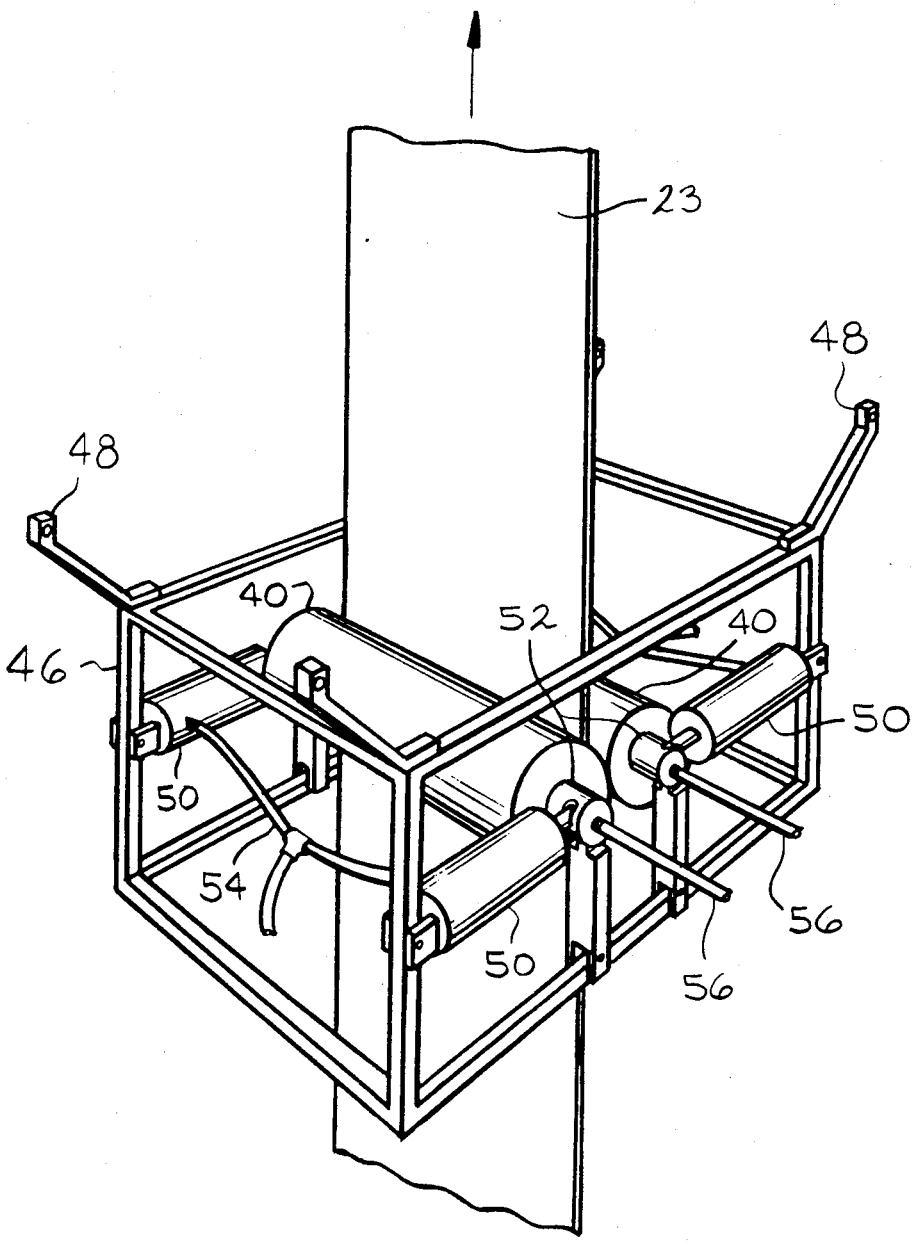
FIG. 3 is an isometric view of a supporting structure for the paper bonding apparatus.
Figure 4:
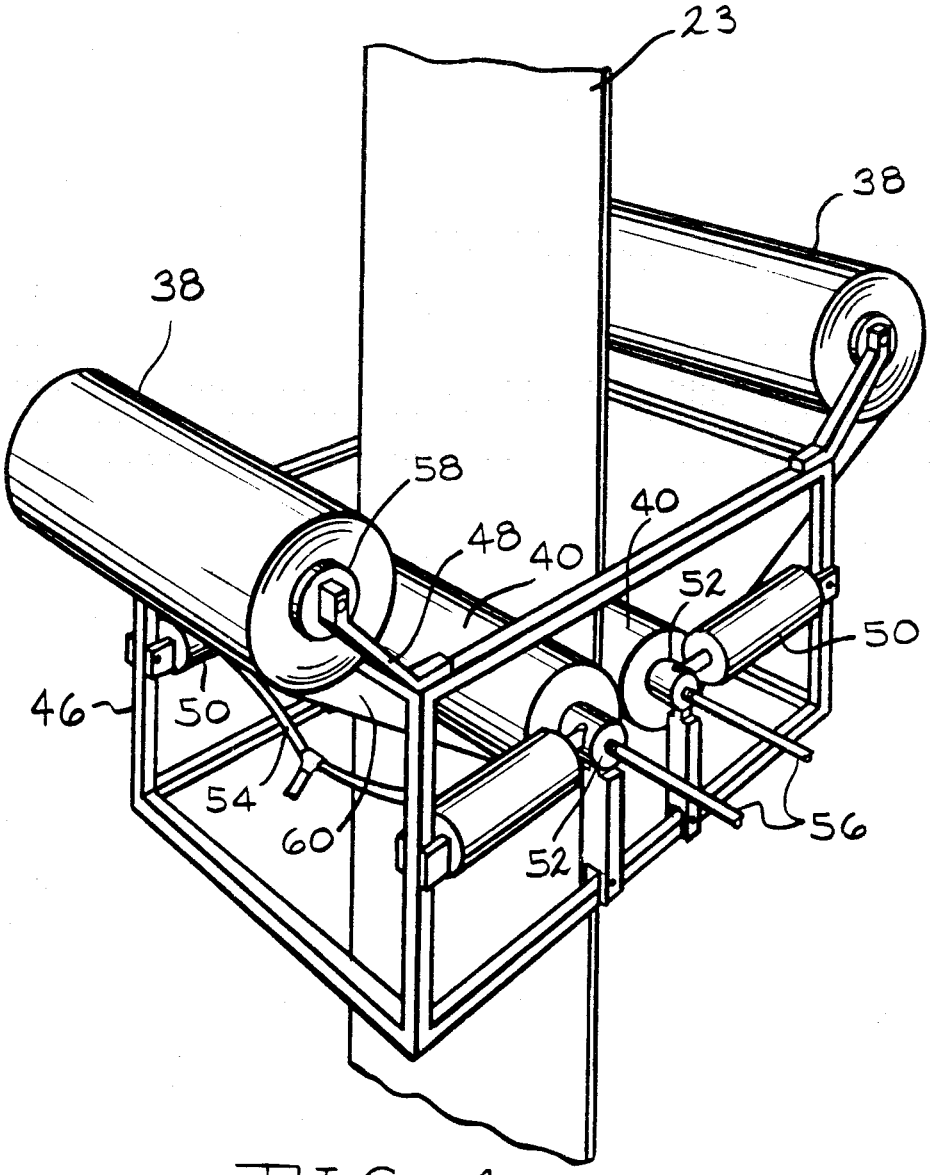
FIG. 4 is similar to FIG. 3 but with the fibrous paper in place.

FIGS. 2–4 illustrate in detail one embodiment for carrying out the present invention. A supporting structure for feeding paper 60 is located a short distance, preferably less than 10 ft. (3 m), above the coating pot 30. The supporting structure includes frame 46 and mounting brackets 48 for supporting roll 38 on spool 58. Although not shown, it may be desirable to install a brake on spool 58 to apply some back tension on paper 60.

As is well known, paper 60 must be permeable to molten coating metal 32 and be temperature resistant at or above the melting point of coating metal 32. To insure good bonding of paper 60 to a metallic coating, the paper must be pressed into the coating metal while still molten so that liquid metal will penetrate into the voids between individual fibers. On the other hand, it is important the temperature of ferrous strip 22 not greatly exceed the melting point of coating metal 32. If the temperature is too high, most of the coating metal forms an iron alloy which has poor adherence to strip 22.

To form good bonding with the metallic coating layer, sufficient pressure needs to be applied to embed paper 60 into the molten coating layer. For this purpose, we prefer to use hydraulic cylinders 50 mounted with bearing housings 52 of bonding rollers 40. We have found that varying the hydraulic pressure on cylinder 50 affects the depth of embedment of the paper and the amount of molten metal left on the ferrous strip. The amount of pressure needed depends on the strip temperature, thickness of the coating metal and the diameter of bonding roller 40. We operated successfully using the invention at line speeds of at least 40 ft./min. (12.3 m/min.). At these or higher coating speeds, the pressure on rollers 40 may need to be increased to wipe excess coating metal from the strip. In general, we have found it is also important to maintain a constant pressure over the entire contact surface of bonding roller 40. For example, if roller 40 becomes out of round because of improper machining or distorted because of hot spots, pressure surges or fluctuations will occur which may result in poor bonding of the paper to the metallic coating layer. Accordingly, it is preferred to cool roller 40 to maintain a uniform temperature. A satisfactory cooling means is to circulate water such as through water lines 56.

The importance of pressing paper 60 into the molten coating layer was discussed previously. We indicated the coating metal must be molten to permeate the paper but not be so hot as to cause excessive alloy formation. Using water or air cooled bonding roller 40 helps to rapidly chill the molten coating shortly after the paper becomes saturated by the molten metal.

We have discovered that thin composite nonwoven sheet or paper 60 of synthetic polymer comprising staple fiber and a fibrid bonding agent can be used as a replacement for inorganic fibers such as asbestos, glass, carbon and the like if the polymer has the necessary heat resistance. Such a paper is described in U.S. Pat. Nos. 2,999,788 and 3,101,294 which are incorporated herein by reference. It is thus known to form a flexible sheet or paper structure including a commingled mixture of about 10–85% by weight of short fibers being bonded by 15–90% by weight fibrids. A "fibrid" is a synthetic polymeric particle capable of forming paper-like structures upon a paper making machine when combined with short fibers. The nonuniformly shaped particles physically entwine the polymeric fibers. One such paper we have found to work very well is sold by the DuPont company of Wilmington, Del. under the registered trademark NOMEX. The synthetic polymer used in this paper is an aromatic polyamide formed from aromatic polyamines and polybaric acids. Aramid papers we have found to give excellent results have a thickness of at least 3 mils (0.1 mm), a tensile strength in both the machine direction (MD) and cross direction (XD) of at least about 10 lbs./in. (18N/cm) and a elongation of at least about 5%. These aramid papers are heat resistant well above the melting temperature of molten metal, i.e. zinc. We have determined the toughness of aramid paper even increases after being bonded with hot dip zinc coatings.

Coated and uncoated lock seam culverts are well known and are described in U.S. Pat. No. 2,136,942 which is incorporated herein by reference. As will be described later, a lock seam pipe is formed by helically winding a strip around a mandrel. The strip longitudinal edges are formed into U-shaped configurations which are coupled to form a helical seam around the as-formed pipe. To make such an article from a strip having a fibrous layer embedded in the metallic coating previously was not thought possible. A first problem associated with the application of continuous asbestos paper to metallic coated steel strip is the low tensile strength of the paper. A second problem is the deterioration due to abrasion of the bonded asbestos layer during handling, corrugating and shipping of the metallic coated steel strip. Furthermore, the bending required to make helical lock seam pipe is more severe than that for riveted pipe. Because the toughness of the synthetic polymer paper is enhanced after being bonded to a metallic coating, we have determined a metallic coated ferrous strip can be severely fabricated into articles, such as culvert, without tearing or crazing of the polymeric paper.

Figure 5:
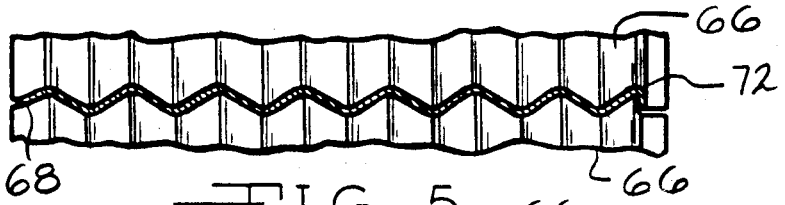
FIGS. 5 and 6 show in cross-section the formation of seam elements during corrugation of a hot dip metallic coated ferrous strip having an embedded polymeric fibrous layer.
Figure 6:
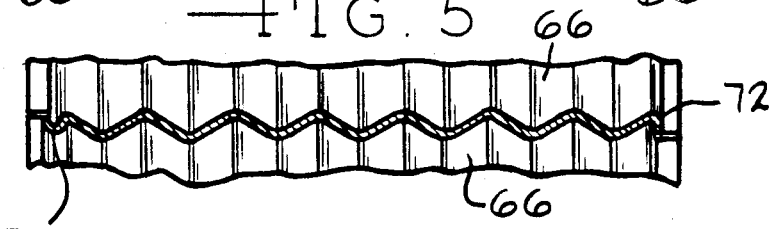
Figure 7:
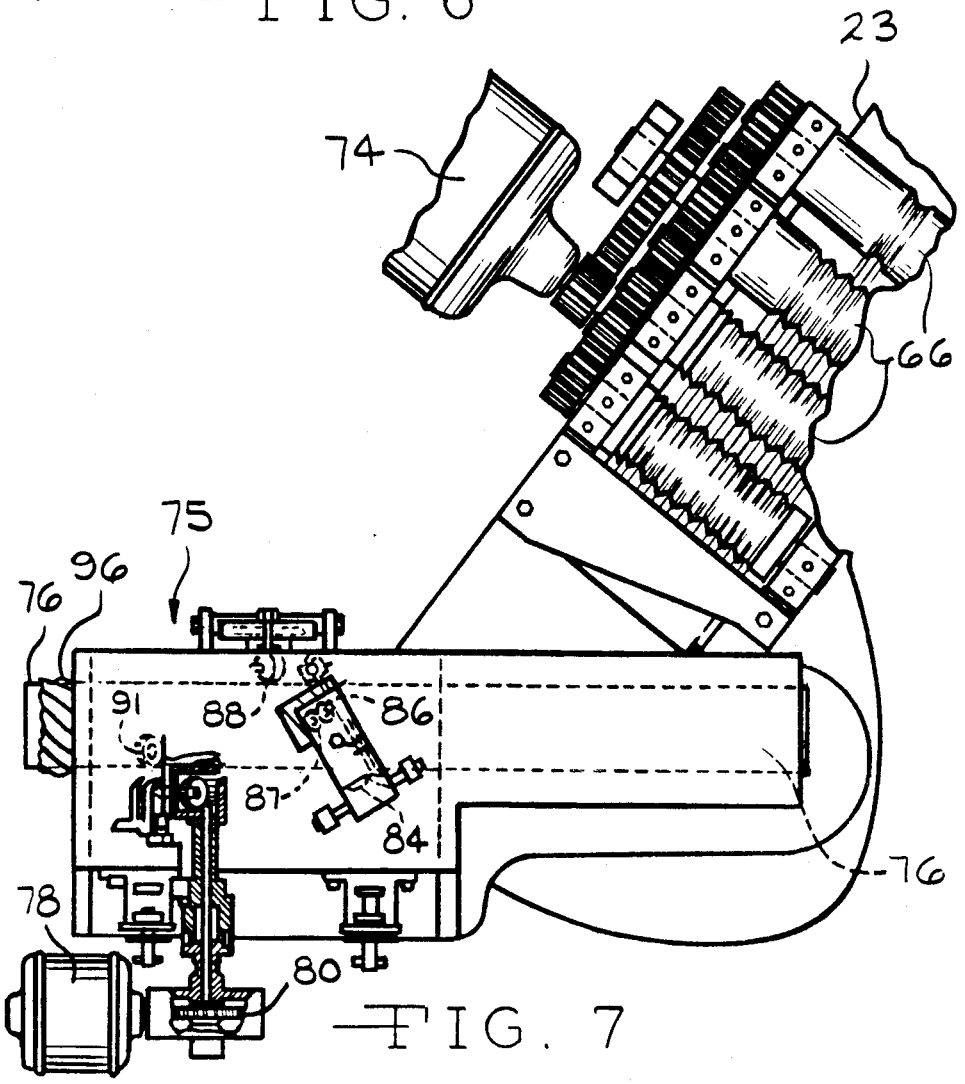
FIG. 7 shows a schematic top view of a conventional pipe forming machine.
Figure 8:
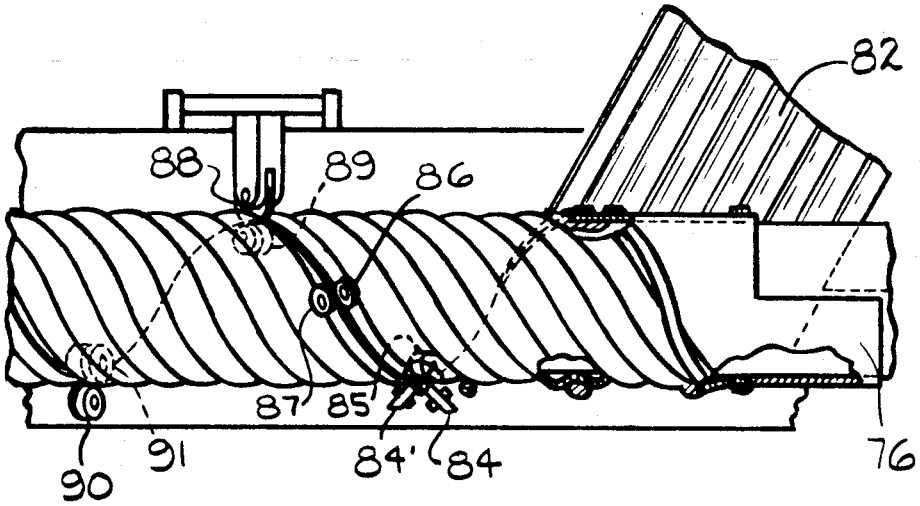
FIG. 8 shows seam forming rollers on a conventional pipe forming mandrel.

Strip 23 having an inner metallic layer and an outer embedded synthetic polymer fibrous layer may be corrugated as illustrated in FIGS. 5 and 6. The strip may be passed through a pair of corrugating rollers 66. A pair of cooperative seam elements on opposite edges of the ferrous strip may be formed. FIG. 5 illustrates a first pair of corrugating rollers 66 wherein flange 68 and an L-shaped seam element 72 are formed. Referring to FIG. 6, flange 68 is further fabricated into a U-shaped seam element 70.

Figure 9:
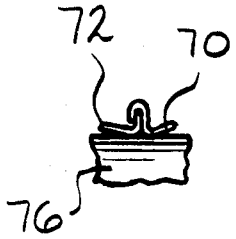
FIGS. 9–13 show sequential cross-sectional views in the formation of a seam.
Figure 10:
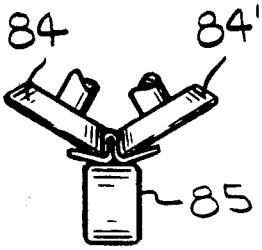
Figure 11:
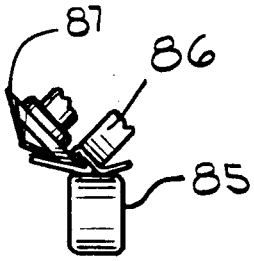
Figure 12:
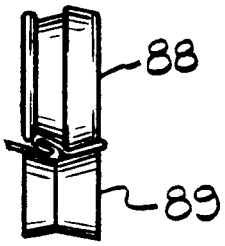
Figure 13:
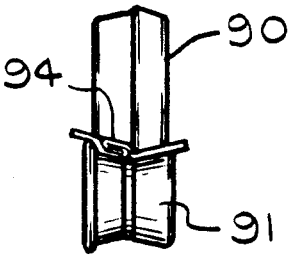
Figure 14:
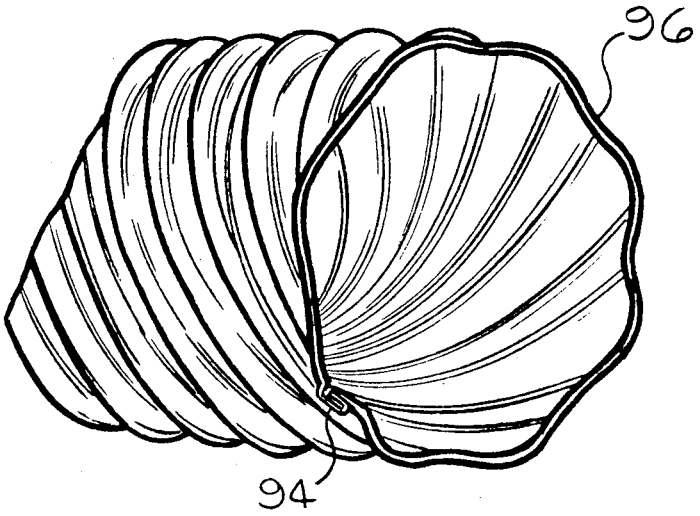
FIG. 14 shows an elevational view of a lock seam formed culvert incorporating the present invention.

Turning now to FIGS. 7–14, helical formation of a lock seam pipe on conventional pipe forming machine 75 is illustrated. Strip 23 is driven by motor 74 through pairs of corrugating rollers 66. Corrugated strip 82 is forced into pipe forming machine 75 set at an angle to the direction of the movement of the strip and helically formed around mandrel 76. A pipe is formed by engaging seam forming elements 70, 72 by using a series of forming rollers. FIG. 9 illustrates the initial engagement of seam elements 70, 72. The seam elements are further formed as shown in FIGS. 10 and 11 using pairs of cooperating rollers 84, 84' and 86, 87 with backup roller 85. Additional pairs of cooperating rollers 88, 89 and 90, 91 illustrated in FIGS. 12 and 13, respectively, complete seam 94 to form helically formed corrugated lock seam pipe 96 as illustrated in FIG. 14. Roller 90 is driven (not shown) by motor 78 through gearing 80. Such a product also is known as culvert in the construction trade. Although there are particular advantages when making helically formed lock seam culvert as illustrated in FIGS. 5–13, it will be understood by those skilled in the art that culvert incorporating our invention could also be helically formed and joined by welding or riveting.

By applying an asphalt coating to a culvert formed from hot dip metallic coated ferrous strip having the embedded composite paper of our invention, superior corrosion protection is obtained. Even though severe bending is required to form the corrugations and lock seam 94, we found the aramid paper does not tear when forming a culvert. After dipping the culvert in asphalt, a good bond of bituminous coating is maintained over the entire surface.

By pressing paper 60 into a molten metallic coating, nonwoven randomly oriented polymeric fibers become anchored into the solidified metallic coating. The fibers project from the metallic coating layer and provide a strong bond to an asphalt coating. The composite coating thus formed of an inner corrosion resistant metallic coating, an outer corrosion resistant bituminous layer continuously anchored by an intermediate polymeric fibrous layer provides superior corrosion resistance to a ferrous substrate.

Long-term immersion tests in corrosive solutions were utilized to test overall bond effectiveness of a composite paper including a synthetic polymer staple fiber and fibrid binding agent. These tests included 9-month exposure periods in 5 different corrosive solutions. The steel samples tested included an inner zinc metallic coating, an outer double dipped asphalt coating and an intermediate aramid composite paper embedded into the metallic coating and anchoring the asphalt coating. Coating bond after the 9 month exposure was evaluated by cutting discrete measured areas of coating and attempting to lift the asphalt.

Coating Performance in Corrosive Test Solutions for 9 Months

| Test Solution | Aramid Paper |
|---|---|
| 3% NaCl (neutral) | no peeling, excellent adherence, no corrosion |
| 3% NaCl + acetic acid to pH 3.0 | no peeling excellent adherence no corrosion |
| 3% NaCl + NaOH to pH 10.5-11.0 | no peeling excellent adherence no corrosion |
| $H_2SO_4$ to pH 2.0 | no peeling excellent adherence, no corrosion |
| Distilled $H_2O$ at 100° F. | no peeling excellent adherence no corrosion |

As can be seen from the above results, using a composite paper of synthetic aramid fibers to bond an asphalt coating to a hot dip metallic zinc coating resulted in excellent corrosion protection and asphalt adherence.

It will be understood various modifications can be made to our invention without departing from the spirit and scope of it. Therefore, the limits of our invention should be determined from the appended claims.

What is claimed is:

1. An article of manufacture including a ferrous base strip having a hot dip metallic coating on at least one side thereof, the improvement comprising:

a heat resistant fibrous layer embedded in said metallic coating, fibers of said fibrous layer projecting from said metallic coating, said fibrous layer including a continuous nonwoven, permeable, fusion bonded, composite paper of synthetic polymer staple fiber and fibrid binding agent, said paper having a tensile strength of at least 10 lbs/in. (18/Ncm) in both the machine and cross directions, an elongation of at least about 5% and having a thickness of at least about 3 mils (0.1 mm), said polymer having a degradation temperature above the melting point of said metallic coating.

2. An article as set forth in claim 1 wherein said paper includes a commingled mixture of about 15-90% by weight of said fibrids and about 10-85% by weight of said fibers.

3. An article as set forth in claim 2 wherein said polymer is aromatic polyamide.

4. An article as set forth in claim 1 wherein said paper has a heat resistance of at least about 790° F. (420° C.).

5. An article of manufacture including a ferrous base strip having a hot dip metallic coating on at least one side thereof, the improvement comprising:

a heat resistant fibrous layer embedded in said metallic coating, fibers of said fibrous layer projecting from said metallic coating, said fibrous layer including a continuous nonwoven, permeable, fusion bonded, composite paper of aromatic polyamide fiber and fibrid binding agent, said paper includes a commingled mixture of about 15-90% by weight of said fibrids and about 10-85% by weight of said fibers, said paper having heat resistance of at least about 790° F. (420° C.), a tensile strength of at least 10 lbs./in (18N/cm.) in both the machine and cross directions, an elongation of at least about 5% and having a thickness of at least about 3 mils (0.1 mm).

* * * * *